US011470926B1

(12) United States Patent
Marmershteyn et al.

(10) Patent No.: US 11,470,926 B1
(45) Date of Patent: Oct. 18, 2022

(54) JEWELRY ITEM WITH ROTATING ORNAMENTS, AND METHODS FOR ITS USE

(71) Applicant: Maurice Kraiem & Company, Beverly Hills, CA (US)

(72) Inventors: Dmitry Marmershteyn, Beverly Hills, CA (US); Desi Kraiem, Beverly Hills, CA (US)

(73) Assignee: Maurice Kraiem & Company, Beverly Hills, CA (US)

( * ) Notice: Subject to any disclaimer, the term of this patent is extended or adjusted under 35 U.S.C. 154(b) by 0 days.

(21) Appl. No.: 17/532,788

(22) Filed: Nov. 22, 2021

Related U.S. Application Data

(60) Provisional application No. 63/177,322, filed on Apr. 20, 2021.

(51) Int. Cl.
*A44C 9/00* (2006.01)

(52) U.S. Cl.
CPC ..... *A44C 9/0053* (2013.01)

(58) Field of Classification Search
CPC ... A44C 9/0053; A44C 9/0061; A44C 9/0007; A44C 9/00; A44C 9/0015; A44C 9/0023; A44C 9/003; A44C 17/02
USPC ..... 63/15, 23, 26
See application file for complete search history.

(56) References Cited

U.S. PATENT DOCUMENTS 1,672,355 A * 6/1928 Ullman ..... A44C 9/00 63/15
4,879,882 A * 11/1989 Johnson ..... A44C 15/004 63/4
8,196,428 B2 * 6/2012 Meltzer ..... A44C 17/0233 63/38
2016/0106186 A1 * 4/2016 Noble ..... A44C 17/0258 63/3

* cited by examiner

*Primary Examiner* — Jack W Lavinder

(57) ABSTRACT

Jewelry items having at least one rotating ornament to capture a wearer's or viewer's attention are disclosed. The jewelry item may be a ring or pendant having at least one axle. At least one ornament may be coupled about the axle and the ornament may be configured to spin or rotate around the axle as well as slide along the length of the axle. At least one prong may be coupled to the body of the jewelry item to hold a stone in a position above the axle and rotating ornaments.

15 Claims, 11 Drawing Sheets

JEWELRY ITEM WITH ROTATING ORNAMENTS, AND METHODS FOR ITS USE

CROSS-REFERENCE TO RELATED APPLICATION

This application claims the benefit of U.S. Provisional Application No. 63/177,322, filed on Apr. 20, 2021, titled JEWELRY ITEM WITH ROTATING ORNAMENTS, AND METHODS FOR ITS USE. The entire contents of the foregoing are hereby incorporated in full by reference.

TECHNICAL FIELD

The present disclosure relates to jewelry and, more particularly, to a jewelry item with rotating ornaments such as gems or stones and methods for their use.

BACKGROUND

Jewelry may be worn to accentuate a user's look. A ring, which is a popular piece of jewelry, may be placed on the user's finger. In traditional rings, a round band may be used to surround the wearer's finger. The round band may be made of metal such as gold, silver, or platinum. Other types of material may include wood, bone, stone, metal, glass, or plastic. Above the round band, one or more prongs may be used to secure precious or semi-precious stones. These stones may include a diamond, ruby, sapphire, or emerald, for example. The stone may also be a birthstone, which indicates a respective month and day of a week in and on which the user was born.

Pendants, charms, and earrings are also other popular pieces of jewelry. These pieces of jewelry may also be made of metal such as gold, silver, or platinum. Other types of material may include wood, bone, stone, metal, glass, or plastic. The pendant, charm, or earring may have a body of a particular shape; e.g. heart, teardrop, rectangle, etc. Similar to the band of a ring, as described above, the body of the pendant, charm, or earring may have one or more prongs that may be used to secure precious or semi-precious stones. These stones may include a diamond, ruby, sapphire, or emerald, for example. The stone may also be a birthstone, which indicates a respective month and day of a week in and on which the user was born.

Current pieces of jewelry have limitations, however. They often do not provide the ability to capture the user's attention. That is, the static nature of current pieces of jewelry often do not keep the user interested and the user often yearns for additional jewelry items. With that, the ability to provide jewelry with movable parts may become increasingly important in the current marketing environment. The present disclosure provides for a jewelry item with rotating ornaments and methods for its use that addresses the above-identified concerns. Other benefits and advantages will become clear from the disclosure provided herein and those advantages provided are for illustration. The statements in this section merely provide the background related to the present disclosure and do not constitute prior art.

SUMMARY

This summary is provided to introduce a selection of concepts in a simplified form that are further described below in the DESCRIPTION OF THE DISCLOSURE. This summary is not intended to identify key features of the claimed subject matter, nor is it intended to be used as an aid in determining the scope of the claimed subject matter.

According to one aspect of the present invention, a jewelry item is disclosed. In this embodiment, the jewelry item may be a ring. The ring may include a ring body/band and one or more axles formed within the ring body/band for receiving at least one rotating ornament. In addition, the ring may include at least one prong positioned above the axle securing a stone.

According to another aspect of the present disclosure, a jewelry item is disclosed. The jewelry item may include a body/band and an axle at an open upper portion of the body/band. The jewelry item may also include at least one rotating ornament held into place by the axle.

According to yet another aspect of the present invention, a method of constructing a jewelry item is disclosed. The method may include forming a band/body and placing an axle at an open upper portion of the band/body. The method may also include inserting an axle through the opening of at least one rotating ornament to secure the rotating ornaments thereon and setting at least one prong positioned above the axle.

According to one aspect of the present invention, a jewelry item is disclosed that may include a band/body, a plurality of prongs to support stones along the band/body, and a plurality of rotating ornaments held into place on the band/body and positioned between the plurality of prongs.

According to one aspect of the present invention, a jewelry item is disclosed. The jewelry item may comprise: a body; at least one axle coupled to the body; and at least one ornament coupled to the at least one axle; wherein the at least one ornament is coupled to the at least one axle by passing the at least one axle through a hole defined by the at least one ornament.

According to one aspect of the present invention, a jewelry item with rotating ornaments is disclosed. The jewelry item with rotating ornaments may comprise: a body having an open configuration with two open ends; at least one axle, wherein a first end of the at least one axle is coupled to the body proximate one open end of the body and a second end of the at least one axle is coupled to the body proximate the other open end of the body; and at least one ornament coupled to the at least one axle; wherein the at least one ornament is coupled to the at least one axle by passing the at least one axle through a hole defined by the at least one ornament; and wherein a diameter of the at least one axle is less than a diameter of the hole defined by the at least one ornament, thereby allowing the at least one ornament to rotate about the at least one axle and slide along a length of the at least one axle.

According to one aspect of the present invention, a jewelry item with rotating ornaments is disclosed. The jewelry item with rotating ornaments may comprise: a body having a closed configuration; a plurality of axles that are integral to the body; and at least one ornament coupled to each of the plurality of axles; wherein the at least one ornament is coupled to the at least one axle by passing the at least one axle through a hole defined by the at least one ornament; and wherein a diameter of the at least one axle is less than a diameter of the hole defined by the at least one ornament, thereby allowing the at least one ornament to rotate about the at least one axle and slide along a length of the at least one axle.

BRIEF DESCRIPTION OF THE DRAWINGS

The novel features believed to be characteristic of the disclosure are set forth in the appended claims. In the descriptions that follow, like parts are marked throughout the specification and drawings with the same numerals, respectively. The drawing FIGURES are not necessarily drawn to scale and certain FIGURES may be shown in exaggerated or generalized form in the interest of clarity and conciseness. The disclosure itself, however, as well as a preferred mode of use, further objectives and advantages thereof, will be best understood by reference to the following detailed description of illustrative embodiments when read in conjunction with the accompanying drawings, wherein:

DESCRIPTION OF THE DISCLOSURE

The description set forth below in connection with the appended drawings is intended as a description of exemplary embodiments of the disclosure and is not intended to represent the only forms in which the present disclosure may be constructed and/or utilized. The description sets forth the functions and the sequence of blocks for constructing and operating the disclosure in connection with the illustrated embodiments. It is to be understood, however, that the same or equivalent functions and sequences may be accomplished by different embodiments that are also intended to be encompassed within the spirit and scope of this disclosure.

FIGS. 1-14 disclose jewelry items in accordance with the present invention. More particularly, this disclosure describes jewelry items having at least one rotating ornament that may be used to capture a wearer's or viewer's attention. In an illustrative embodiment, the jewelry item may be a ring having a body (also referred to as a band). At an open upper portion of the body/band may be an axle. The at least one rotating ornament may be secured on the axle by passing the axle through an aperture/hole of each rotating ornament. The at least one ornament may spin or rotate about the axle as well as slide along a length of the axle. At least one prong may be coupled to the band and the at least one prong may be positioned to secure a stone above the axle. In another illustrative embodiment, the jewelry item may be a pendant or charm (shown in FIG. 12). The pendant or charm may have a body where the body has a plurality of prongs to support stones along the body and a plurality of rotating ornaments held into place between each pair of the plurality of prongs.

Numerous other modifications or configurations to the jewelry item will become apparent from the description provided below. For example, the axle may be permanently secured to the body/band such that ornaments located thereon may be permanently retained. Alternatively, the axle may be hinged or removable such that the ornaments may be inserted or extracted from the jewelry item. This would allow for the jewelry item to be updated with new ornaments. Advantageously, the at least one rotating ornament may remove the static nature of a typical jewelry item and keep the wearer interested in the jewelry item. Other benefits and advantages will become clear from the disclosure provided herein and those advantages provided are for illustration.

Figure 1:
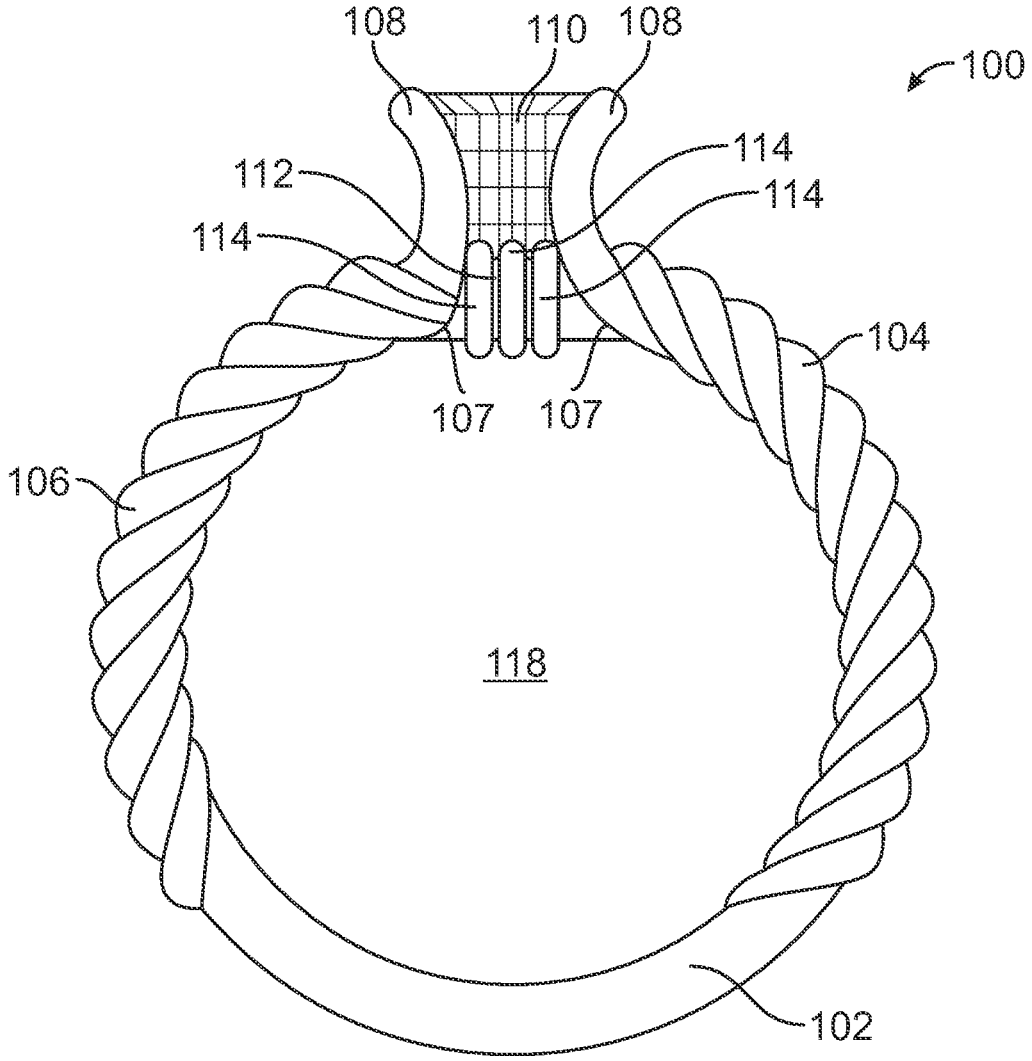
FIG. 1 is a side view representing an illustrative jewelry item having multiple rotating ornaments in accordance with one aspect of the present disclosure.

Turning to FIG. 1, a side view representing an illustrative jewelry item having multiple rotating ornaments 114 in accordance with one aspect of the present disclosure is provided. The jewelry item may be in the form of a ring 100 but is not limited thereto. For example, the jewelry item may be a bracelet, earring, brooch, necklace, charm, pendant, cufflink, and the like.

The ring 100 has a body 102, which may also be referred to as a band. The body 102 may be circular shaped, oval shaped (not shown), or any other suitable shape. The body 102 may have an open configuration (see FIG. 1, 4, 5, 6, 8) or the body 102 may have a closed configuration (see FIGS. 11-14). The body 102 of the ring 100 may be fitted to a user's particular size which is generally the cross dimensions of their finger. Common ring sizes for women are 6 (16.5 mm), 6.5 (16.9 mm), and 7 (17.3 mm), while typical ring sizes for men are 10 (19.8 mm), 10.5 (20.2 mm), and 11 (20.6 mm).

Gold, platinum, or other suitable metals may be used to construct the entire ring 100. In one example, the body 102, prongs 108, and axle 112 may be made of the same metals. Various materials may also be used to construct different elements of the ring 100 and the ring 100 is not limited to a uniform composition. Furthermore, and as shown in FIG. 1, etchings or engravings may be carved into the body 102 of the ring 100. The ring 100 may incorporate spiral-like etchings that extend on the right side 104 of the ring 100 and the left side 106 of the ring 100. Other types of aesthetics may be incorporated into the ring 100 and are not limited to those shown. It should also be clearly understood that substantial benefit may be derived from a ring 100 that does not have etchings or engravings carved into the body 102 of the ring 100.

In FIG. 1-8, the body 102 alone does not form an enclosed opening 118 through which a user would insert their finger. Rather, the body 102 has an open configuration with two open ends 107; the two open ends 107 are shown as opposing one another. As shown in FIGS. 1, 4, 5, 6 and 8, the body 102 with an open configuration may be held such that the two open ends 107 are in an upper, or northern, position respective to the rest of the body 102. Therefore, the axle 112 may be described as being positioned at an open upper portion of the body 102, between the two open ends 107. A first end of the axle 112 may be coupled to one of the open ends 107 and a second end of the axle 112 may be coupled to the other open end 107 of the body 102, thereby connecting the two open ends 107 and completing/enclosing the opening 118 through which the user would insert their finger (or toe). The axle 112 may be curved or straight (not shown).

As shown in FIG. 1, the axle 112 holding the rotating ornaments 114 may have a diameter equal to the diameter of the body 102. Or, according to another embodiment, the axle 112 may have a diameter that is smaller than the diameter of the body 102 (shown in FIGS. 4, 5, 6, and 8). In one embodiment, the axle 112 may be permanently affixed to the open upper portion of the body 102. With respect to construction of the ring 100, the axle 112 may be soldered into place after the ornaments 114 are placed thereon. In another embodiment, the axle 112 may pivot or be hinged such that either the entire axle 112 or a portion of it would be allowed to move away from the ring 100 so that the rotating ornaments 114 may be placed thereon. By allowing this, ornaments 114 may be replaced, removed, or added into the ring 100. Other securing mechanisms may be used to retain the axle 112 into the ring 100.

The ornaments 114 may rotate or spin about the axle 112. The ornaments 114 may define an aperture/hole 116 within them whereby the axle 112 may be inserted into the hole 116 (see FIG. 3). In one example, the ornaments 114 may be shaped in the form of a bead. The bead may be made of a smooth stone, bone, shell, glass, plastic, wood, pearl, or the like. The ornament 114 may incorporate a wide range of designs including, but not limited to, holiday themes, religious themes, astrological signs, varsity letters, graduation year, wedding themes, commercial characters, TV characters, messages such as "I Love You", etc. The ornaments 114 may include different color stones to match different color clothing, birth stones, etc., or may provide different motifs such as initials. Depending on the diameter of the cross section of the axle 112, the ornaments 114 may slide along the length of the axle 112 or be held firmly into place.

Coupled to and extending outwardly/radially from the body 102 of the ring 100 may be at least one prong 108. The prongs 108 may typically hold a jewel/stone 110. From this side view, two prongs 108 are shown being used to hold a stone 110 above the axle 112 and the ornaments 114. The prongs 108 may have a claw-like shape that holds the stone 110, such as a diamond, into place. The prongs 108 may be rounded, pointed, flat, V-shaped, or have any other suitable shape as long as they secure the stone 110 into place.

The stone 110 may be a gemstone. The gemstone may be a diamond, ruby, sapphire, emerald, or the like. The stones 110 may be precious or semi-precious. The prongs 108 may be shaped and set to hold or retain the stone 110 into place on the ring 100. Although only one stone 110 is shown in FIG. 1, it should be clearly understood that substantial benefit may be derived from having multiple stones 110 placed on the ring 100 and held into place with additional prongs 108.

Figure 2:
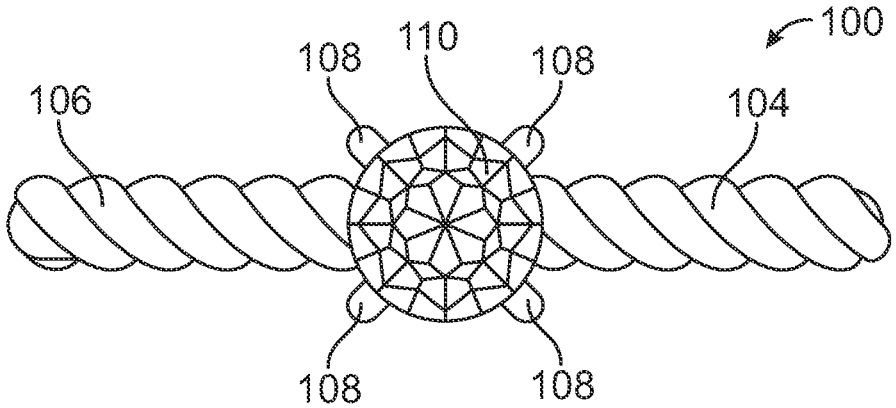
FIG. 2 is a top view of the illustrative jewelry item of FIG. 1.

FIG. 2 is a top view of the ring 100 of FIG. 1. The top view shows the right side 104 of the ring 100 and the left side 106 of the ring 100. From this top view, four prongs 108 are shown equally spaced apart and being used to hold the stone 110 into place. A single stone 110 has been shown, however, this may be modified to different configurations to hold multiple stones 110.

Figure 3:
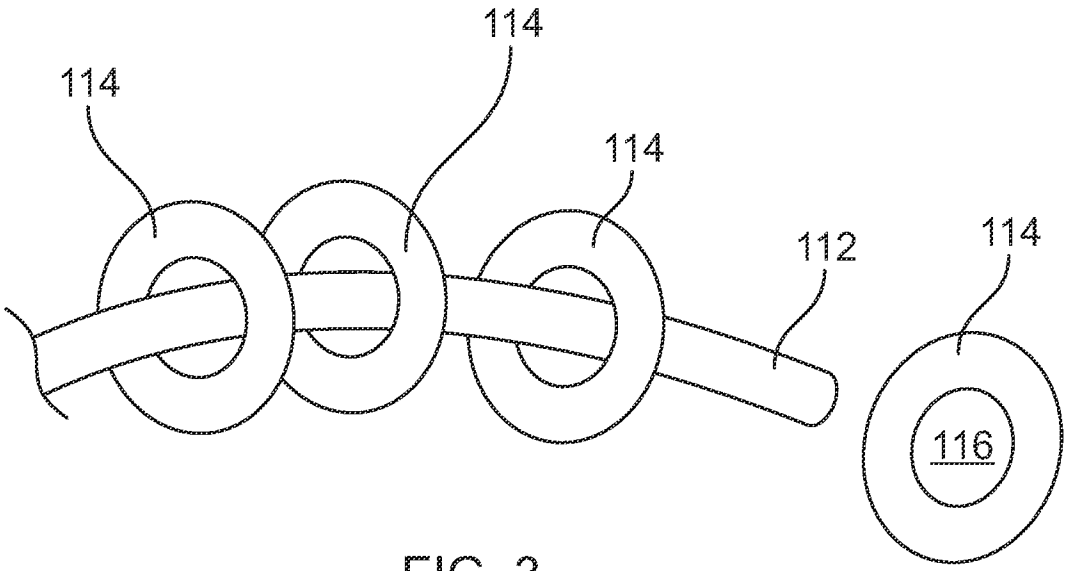
FIG. 3 is partial perspective view of an exemplary axle of a jewelry item of the present disclosure where the axle is shown passing through the holes of the rotating ornaments in accordance with one aspect of the present disclosure.

With reference to FIG. 3, an exemplary axle 112 of the illustrative jewelry item having rotating ornaments 114 in accordance with one aspect of the present disclosure is provided. The axle 112 is shown having a diameter that is smaller than a diameter of the hole 116 of each ornament 114. This configuration allows the ornaments 114 to rotate freely about the axle 112. This configuration also allows the ornaments 114 to slide freely along the length of the axle 112.

In another embodiment, the axle 112 may have a diameter that is equal to the diameter of the hole 116 of each ornament 114 (see FIG. 1). This configuration would hold the ornaments 114 firmly into place on the axle 112, preventing the ornaments 114 from rotating about the axle 114 and preventing the ornaments 114 from sliding along the length of the axle 112.

The axle 112 may take an angular or curved shape that corresponds with the top portion of the body 102 of the ring 100. In construction, the ornaments 114, each having a hole 116 therein, may be slid over the axle 112. Multiple ornaments 114 may be placed thereon and is not limited to the four (4) shown. It should be clearly understood that substantial benefit may also derived from only one ornament 114 being placed on the axle 112.

Figure 4:
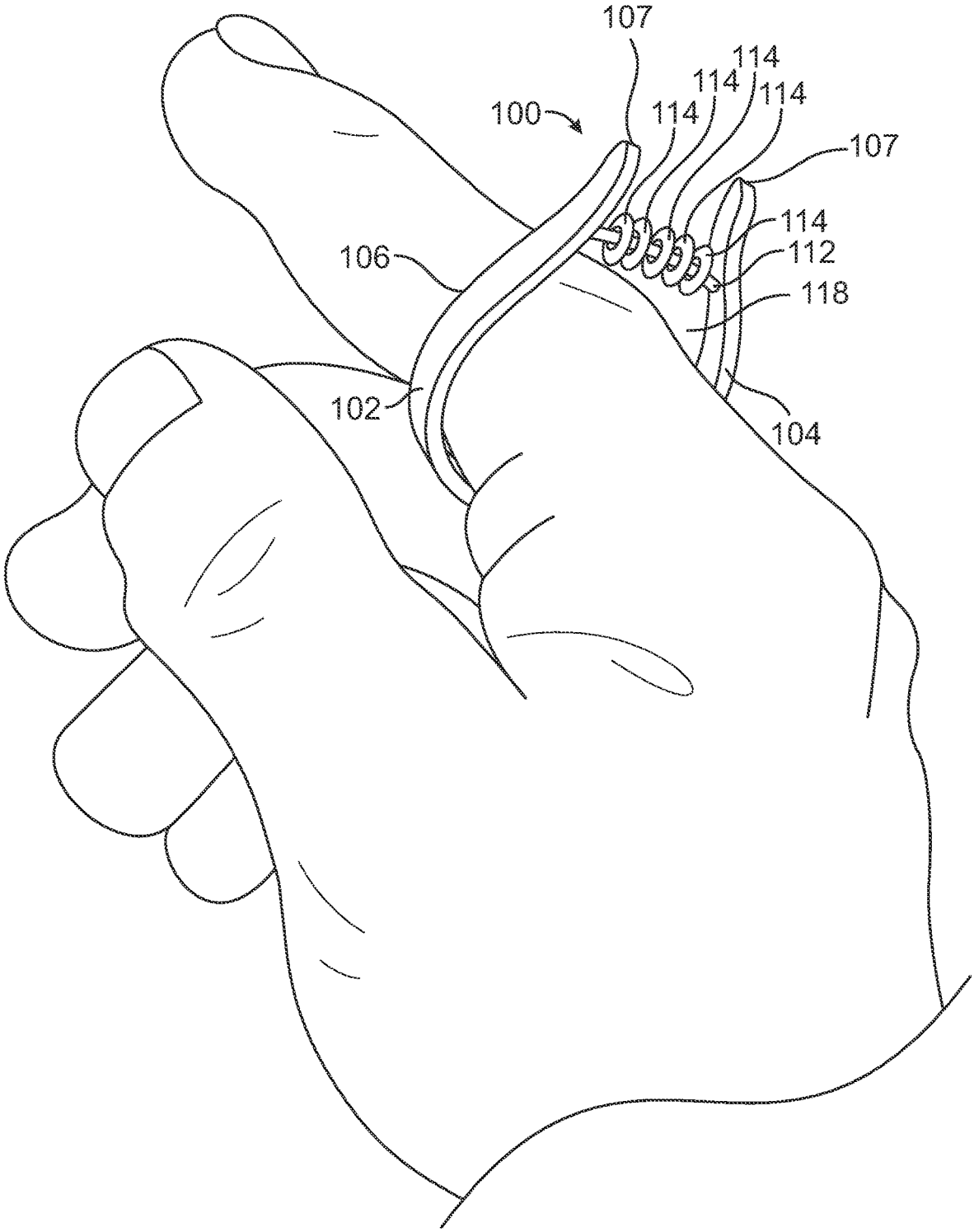
FIG. 4 is a perspective view of another illustrative jewelry item placed on the finger of a user, where the axle is coupled at an open upper portion of the body/band, thereby forming a portion of the body/band, and where the axle secures the rotating ornaments thereon in accordance with one aspect of the present disclosure.

FIG. 4 is a perspective view of another illustrative jewelry item enclosing the exemplary axle 112 which secures the rotating ornaments 114 thereon in accordance with one aspect of the present disclosure. The ring 100 is shown in use on the finger of a user. The body 102 of the ring 100 is flat and has an open U-shaped configuration with two open ends 107. The axle 112 of this ring 100 is not coupled to the open ends 107 of the body 102. Rather, both ends of the axle 112 are coupled to the body 102 at positions below the open ends 107. Despite the axle 112 being positioned below the open ends 107 (rather than between the open ends 107), the axle 112 nevertheless still helps to complete/enclose the opening 118 through which a user would insert their finger. The right side 104 of the ring 100 and the left side 106 of the ring 100 are angled upwards during the construction of the ring 100.

The axle 112 may be placed within the space between the right side 104 of the ring 100 and the left side 106 of the ring 100, below the two open ends 107. In this axle 112 configuration, and in its construction, the axle 112 may be permanently affixed to the body 102. This may include soldering the ends of the axle 112 to the ring body 102. Furthermore, the space may allow the ornaments 114 to float freely above the user's finger without irritating or annoying the user.

Figure 5:
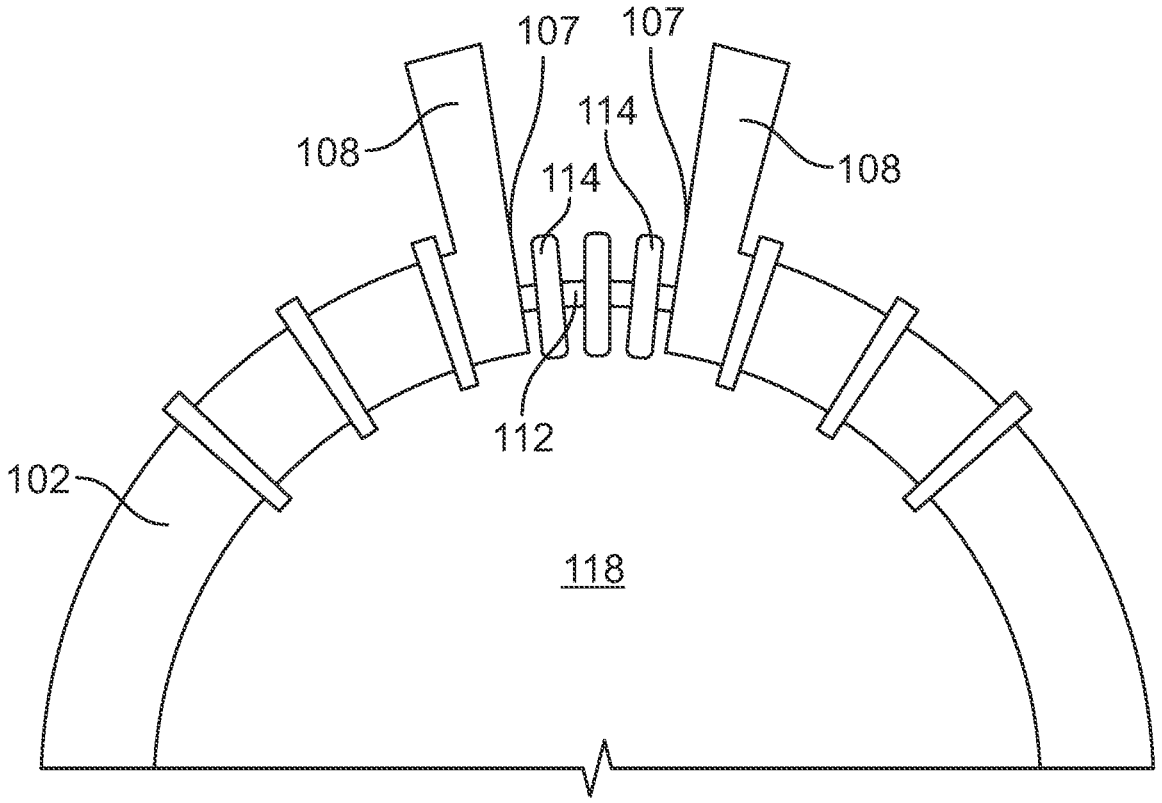
FIG. 5 is a partial side view of another illustrative jewelry item where the axle is coupled at an open upper portion of the body/band, thereby forming a portion of the body/band, and where the axle secures the rotating ornaments thereon in accordance with one aspect of the present disclosure.

FIG. 5 is a close-up side view of another illustrative jewelry item with the exemplary axle 112 which secures the rotating ornaments 114 thereon in accordance with one aspect of the present disclosure. In this embodiment, the body 102 has an open configuration with two open ends 107.

An open upper portion of the body 102 has been omitted and a prong 108 is coupled to and extends outwardly from each open end 107 of the body 102. The two open ends 107 of the body 102 are shown as having been pinched together to secure the axle 112 into place; thereby the axle 112 connects the open ends 107 of the body 102 and thus completes the opening 118 through which a user would insert their finger. In this embodiment, the prongs 108 may be then be used to secure a stone 110 (not shown).

Figure 6:
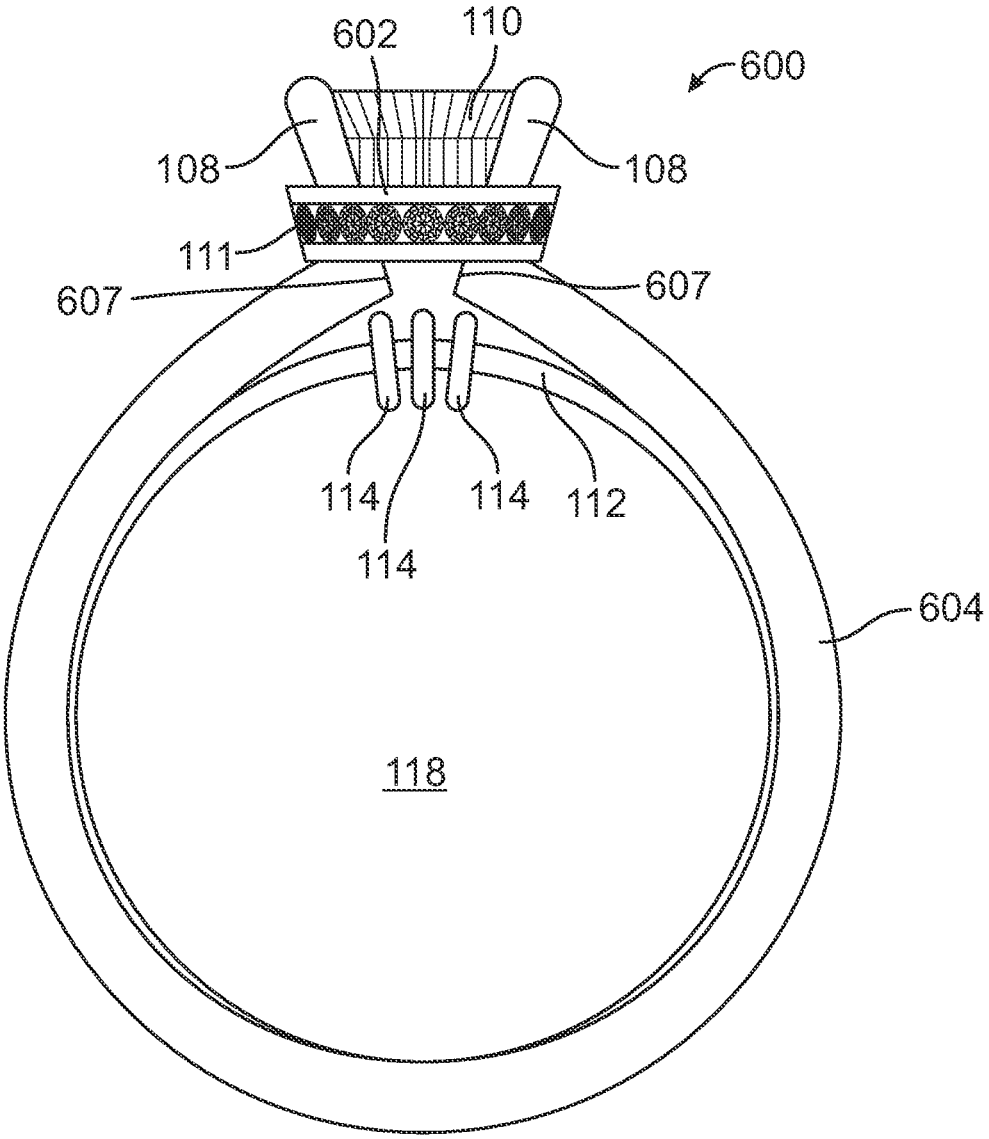
FIG. 6 is a side view of another illustrative jewelry item having multiple rotating ornaments secured on an axle and showing two prongs holding a jewel positioned above the axle in accordance with one aspect of the present disclosure.

Turning to FIG. 6, a side view representing another illustrative jewelry item having multiple rotating ornaments 114 and holding a jewel/stone 110 above the axle 112 in accordance with one aspect of the present disclosure is provided. A variation of some of the previous rings is shown within this ring 600. Similar to some of the previous rings, the body 604 of this ring 600 has an open configuration with two open ends 607. This ring 600 also includes at least one prong 108 to secure a stone 110. As differentiated, a circular retainer 602 may be used to further secure the stone 110. The circular retainer 602 may encircle the prongs 108 and may be soldered or affixed to the prongs 108. One or more jewels/stones 111 may be coupled to the circular retainer 602. But it should be clearly understood that substantial benefit may be derived from a circular retainer 602 that does not have jewels/stones 111 coupled to it (see FIG. 8). A portion of the stone 110 may be positioned within the circular retainer 602 and may be held into place above the axle 112 retaining the ornaments 114. As further differentiated from some of the previous rings (shown in FIGS. 1, and 5), the axle 112 of this ring 600 is not coupled to the open ends 607 of the body 604. Rather, the axle 112 is coupled to the body 604 at a position below the open ends 607. Despite the axle 112 being positioned below the open ends 607 (rather than between the open ends 607), the axle 112 nevertheless still helps to complete/enclose the opening 118 through which a user would insert their finger.

Figure 7:
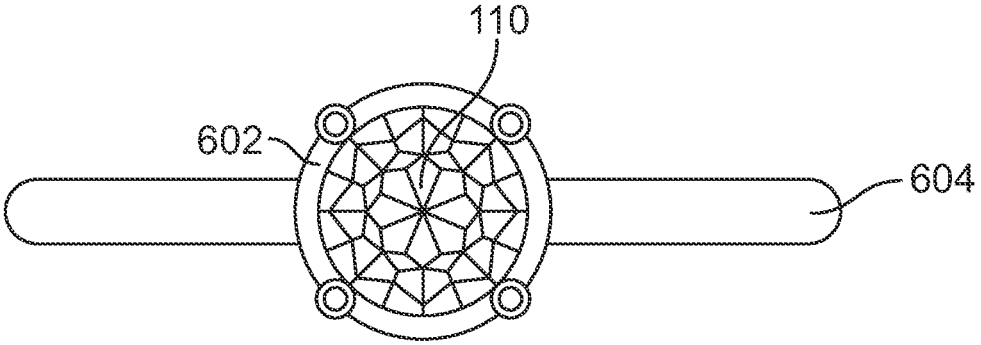
FIG. 7 is a top view of the illustrative jewelry item of FIG. 6.

FIG. 7 is a top view of the ring 600 of FIG. 6. This view clearly shows that the stone 110 may be held into place by the circular retainer 602.

Figure 8:
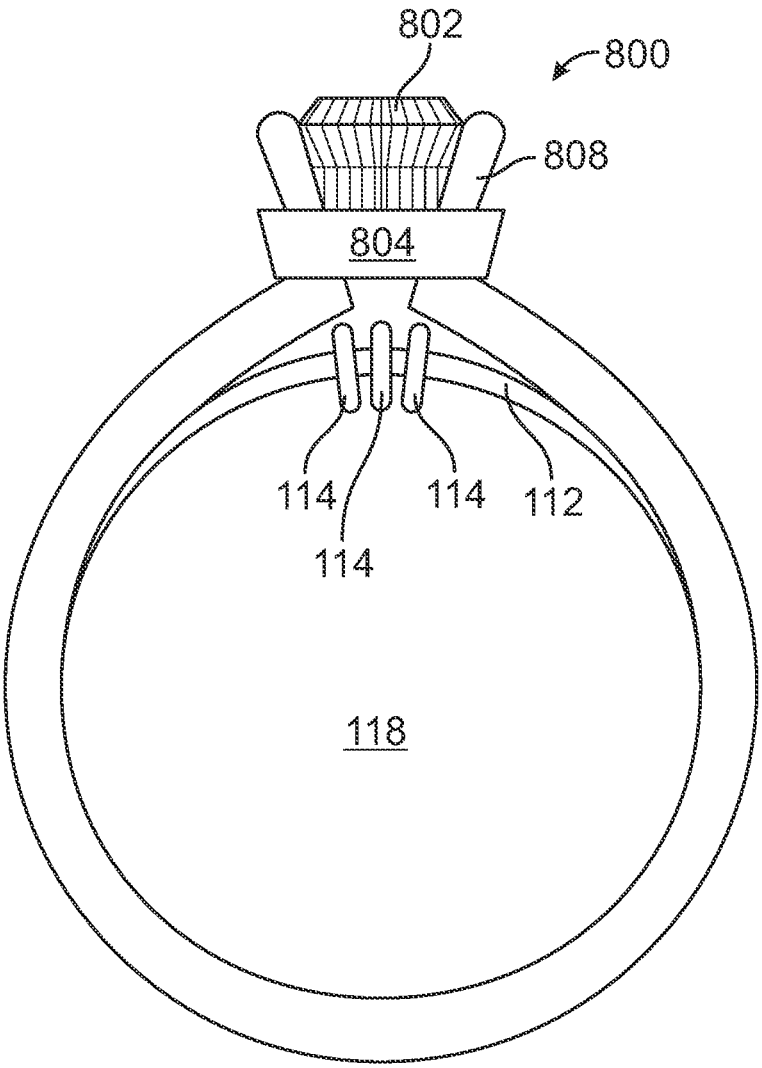
FIG. 8 is a side view of another illustrative jewelry item having multiple rotating ornaments secured on an axle and showing two prongs holding a jewel positioned above the axle in accordance with one aspect of the present disclosure.

FIG. 8 is a side view of another illustrative jewelry item having multiple rotating ornaments 114. This ring 800 has a jewel 802 positioned above the axle 112 in accordance with one aspect of the present disclosure. The ornaments 114 may be placed onto the axle 112 and the jewel 802 may be placed above the axle 112 and the rotating ornaments 114. A circular retainer 804 may encircle the prongs 808 and may be soldered or affixed to the prongs 808. The jewel 802 may be secured by the prongs 808 or other mechanism. The jewel 802 may be a two-tiered structure including multiple stones or jewels (not shown). This ring 800 is similar to the ring 600 of FIG. 6, except that the there are no additional stones in the circular retainer 804.

The above described embodiments and configurations should not be construed as limiting. As an example, the prongs and stone placements above the axle retaining the rotating ornaments may be removed. The removal of the stone and prongs may allow a more visual perception of the rotating ornaments positioned along the axle. In one embodiment, the axle may be raised above a traditional arc of the ring band. This would allow the rotating ornaments to be exposed.

In one embodiment, the ornaments may be made of reflective materials. These materials may include metals which have a lustrous look. Other embodiments may include the ornaments having electrical components with light emitting diodes (LEDs) therein.

In one configuration, a ring may include a bottom pivot point whereby half of the ring band pivots with respect to the other half of the ring band. This action may open the ring band and the axis. The user could thereafter replace, remove, or add new ornaments on the axis. When completed, the pivot point between the two halves of the ring band may be closed to secure the axis into place along with the rotating ornaments.

Figure 9:
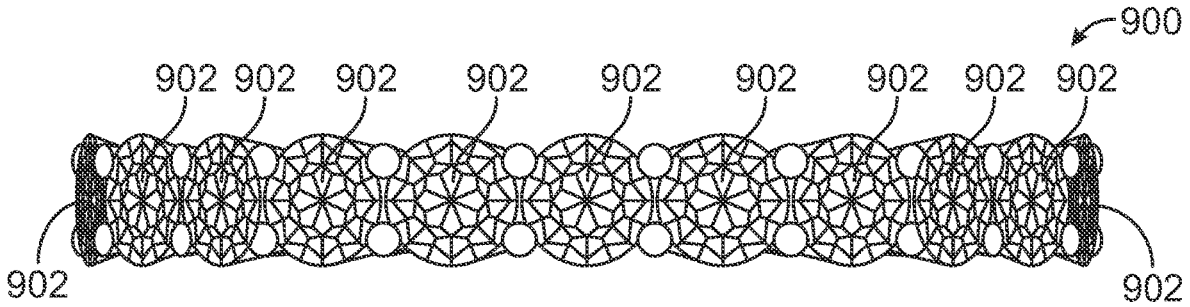
FIG. 9 is a top view of another illustrative jewelry item having a plurality of V-shaped prongs to support stones along a circumference of the body/band, and a plurality of rotating ornaments secured on the body/band and positioned within a space between each pair of adjacent V-shaped prongs.
Figure 10:
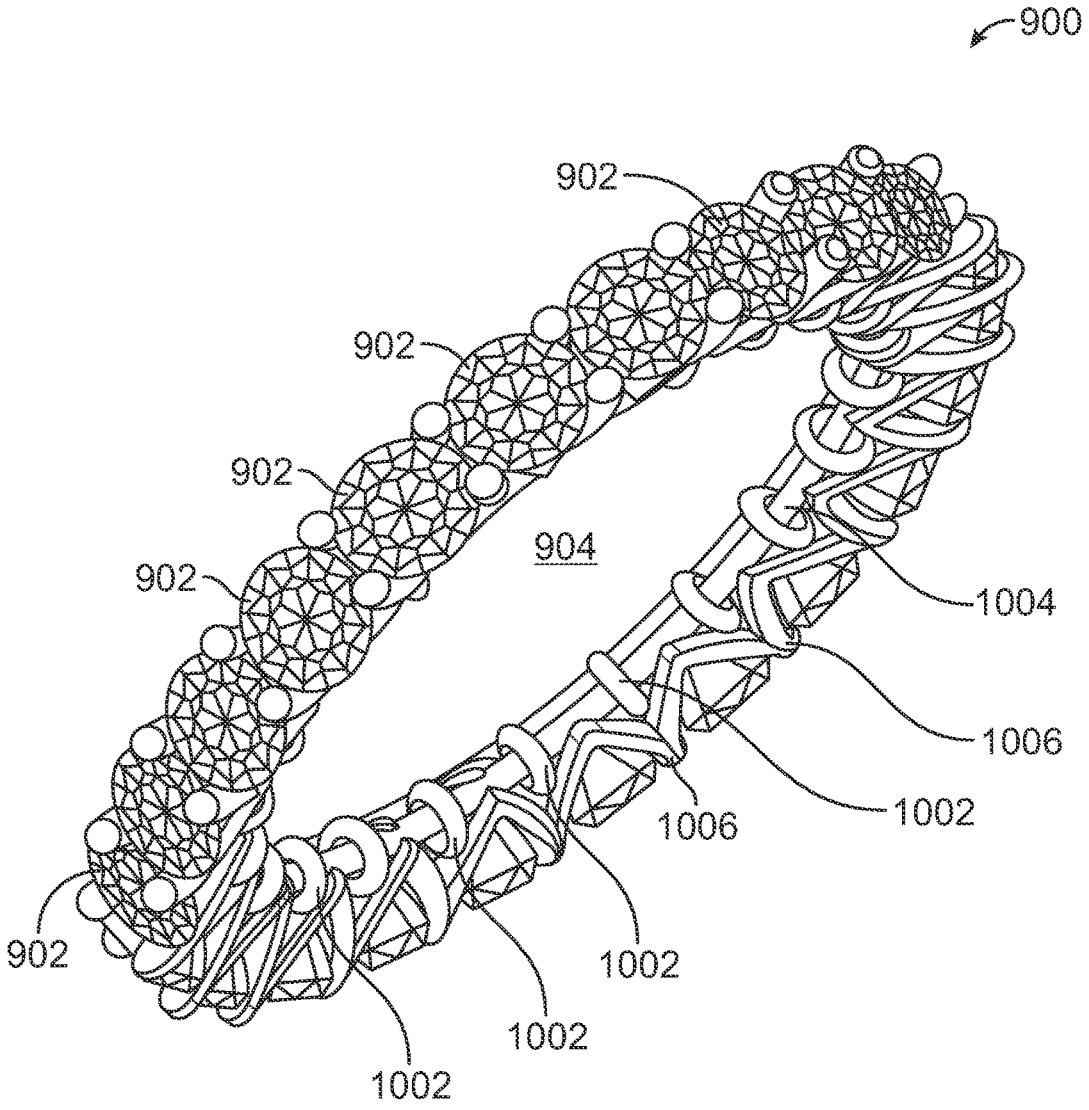
FIG. 10 is a perspective view of the illustrative jewelry item of FIG. 9.
Figure 11:
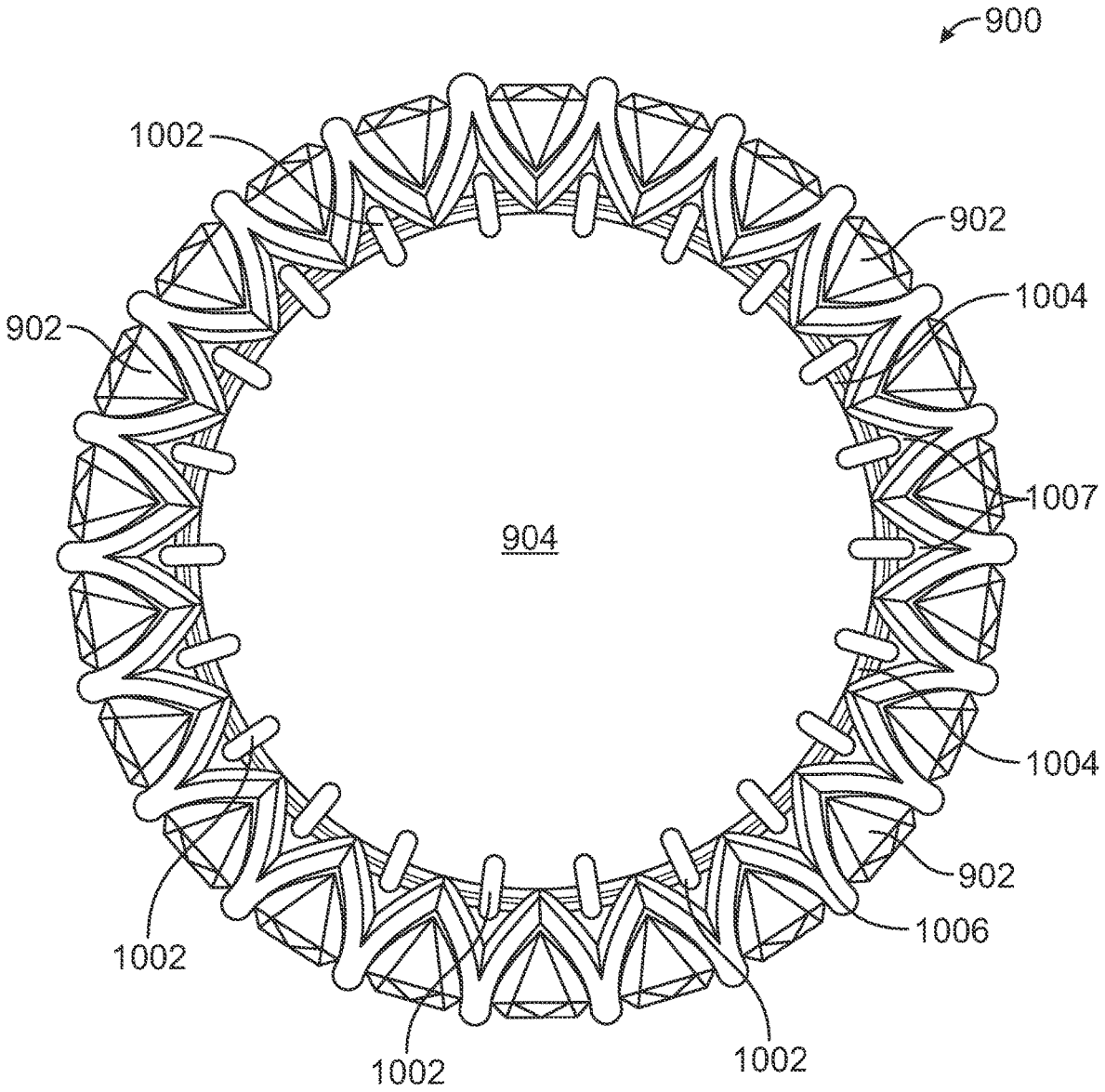
FIG. 11 is a side view of the illustrative jewelry item of FIG. 9.

Turning to FIGS. 9-11, another illustrative jewelry item having multiple rotating ornaments 1002 between stones 902 in accordance with one aspect of the present disclosure is provided. In FIG. 9, the jewelry item is a ring 900 having a body 1004 and having multiple stones 902 coupled thereto. The stones 902 may be gemstones such as a diamond, ruby, sapphire, emerald, or the like. The stones 902 may be precious or semi-precious.

FIG. 10 is a top perspective view that shows that the ring 900 has a body 1004 and the body 1004 is shown as having a closed circular shape. The body 1004 defines a circular opening 904 through which a user may insert their finger. A plurality of prongs 1006 are coupled to and extend outwardly/radially from the body 1004. As shown in the figure, the prongs 1006 are coupled along the entire circumference of the circular shaped body 1004; however, it should be clearly understood that substantial benefit may be derived from prongs 1006 being coupled to only a portion of the circumference of the body 1004. As shown, each prong 1006 is coupled to and extends outwardly/radially from the body 1004. Each of the plurality of stones 902 may be held in place by at least two prongs 1006. In this embodiment, each stone 902 is held into place by two V-shaped prongs 1006 positioned about the stone 902, but it should be clearly understood that other numbers of prongs 1006 and other configurations of the prongs 1006 may be used to secure the stones 902. In an embodiment, where stones 902 are positioned adjacent to each other along the circumference of the circular shaped body 1004, each prong 1006 may be used to help secure a first stone 902 as well as a second adjacent stone 902. The prongs 1006 may be shaped and set to hold or retain the stones 902 into place within the ring 900. The prongs 1006 may be rounded, pointed, flat, or V-shaped. The prongs 1006 and the stones 902 may encompass and circle a user's finger. The stones 902, are shown as being coupled along the entire circumference of the circular shaped body 1004; however, it should be clearly understood that substantial benefit may be derived from stones 902 being coupled to only a portion of the circumference of the body 1004.

Referring to FIG. 11, the ring 900 may have multiple rotating ornaments 1002 positioned between the stones 902 in accordance with one aspect of the present disclosure. The prongs 1006 of this embodiment are V-shaped, thereby creating a triangular-shaped space 1007 between each prong 1006 coupled along the circular circumference of the body 1004.

In one embodiment, the one or more rotating ornaments 1002 may be placed between each of the prongs 1006 that hold up and secure the stones 902. In this embodiment, the axles are integral to the body 1004; i.e. the series of axles that support the ornaments 1002 positioned between the prongs 1006 together form the body 1004 of the ring 900. One or more rotating ornaments 1002 may be coupled to the body 1004. As shown, the body 1004 is passed through the hole of each rotating ornament 1002. Each ornament 1002 may be coupled to the body 1004 and positioned within one of the triangular-shaped spaces 1007 separated by two adjacent prongs 1006. The rotating ornaments 1002 may take the same form as the rotating ornaments 114 described above, having a hole formed therethrough. Alternatively, they may be skinner or narrower in shape. Visually, the rotating ornaments 1002 may rotate freely when not placed on the user's finger. In one embodiment, they may rotate even with the user's finger is within the ring 900.

Figure 12:
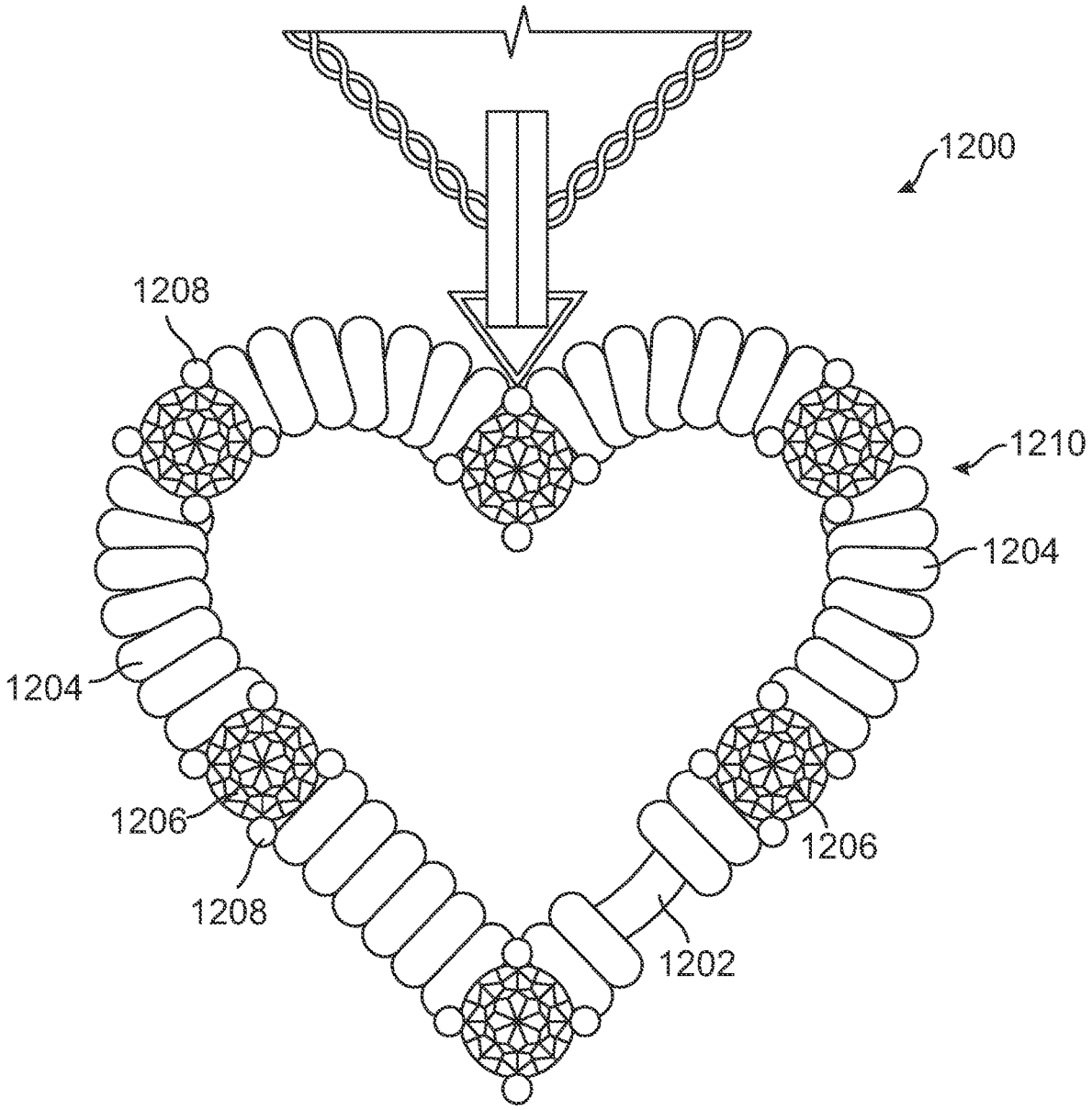
FIG. 12 is a side view of another illustrative jewelry item having a heart-shaped body where the body has a plurality of prongs to support stones along the body and a plurality of rotating ornaments secured on the body and positioned between each pair of the plurality of prongs.

FIG. 12 is another illustrative jewelry item having multiple rotating ornaments 114 wherein the jewelry item is a necklace pendant 1200. The necklace pendant 1200 is shown as having a heart-shaped body 1210. However, it should be clearly understood that substantial benefit may be derived from the pendant 1200 having any suitable shaped body 1210. In this embodiment, a plurality of prongs 1208 are coupled to a plurality of axles 1202 in an alternating pattern and together form the body 1210 of the pendant. In this embodiment, the prongs 1208 are oriented in a position that is perpendicular to the position of the axles 1202. A first end of an axle 1202 is coupled to one prong 1208 (or one set of prongs 1208) and a second end of the axle 1202 is coupled to an adjacent prong 1208 (or an adjacent set of prongs 1208). This pattern continues until the body 1210 of the pendant 1200 is completed. The pendant 1200 also has one or more rotating ornaments 1204 coupled thereto. Each rotating ornament 1204 defines a hole through which the axel 1202 is inserted, thereby allowing the rotating ornament 1204 to be secured to the axle 1202 and positioned between two adjacent prongs 1208 (or sets of prongs 1208).

Similar to other embodiments described herein, each axle 1202 may have a diameter that is smaller than a diameter of the hole of each ornament 1204. This configuration allows the ornaments 1204 to rotate freely about the axle 1202. This configuration also allows the ornaments 1204 to slide freely along the length of the axle 1202. Alternatively, the diameter of the axle 1202 may be equal to the diameter of the hold of the ornament 1204, thereby preventing the ornament 1204 from rotating about the axle 1202 and preventing the ornament 1204 from sliding along the length of the axle 1202.

Although FIG. 12 shows each axle 1202 being full of ornaments 1204, each axle 1202 may have a smaller number of ornaments 1204, thus allowing more room for the ornaments 1204 to move between the two adjacent prongs 1208 (or sets of prongs 1208).

Figure 13:
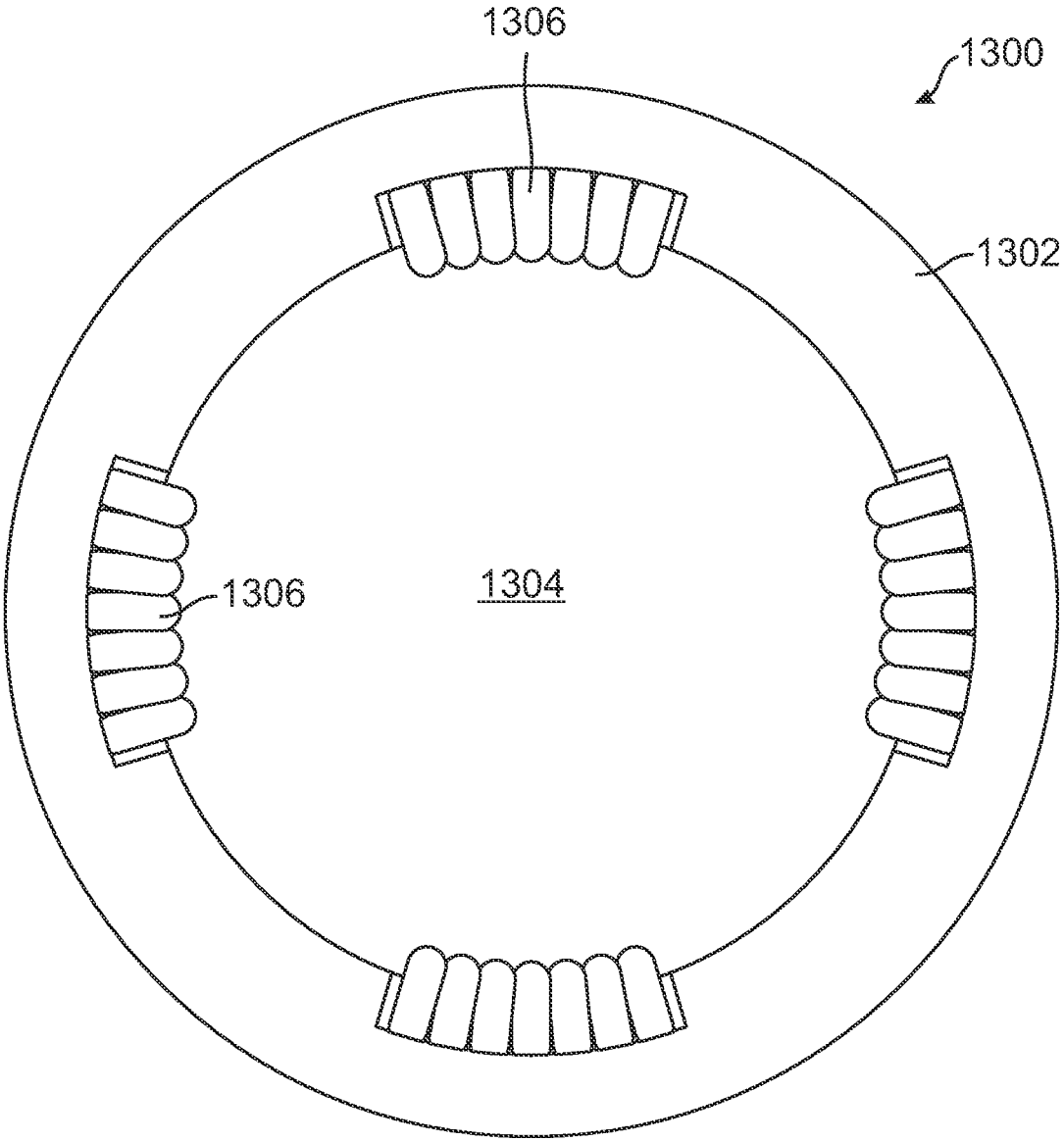
FIG. 13 is side view of another illustrative jewelry item having a body/band and one or more grooves formed within an inner circumference of the body/band and having an axle with rotating ornaments thereon positioned within each groove.
Figure 14:
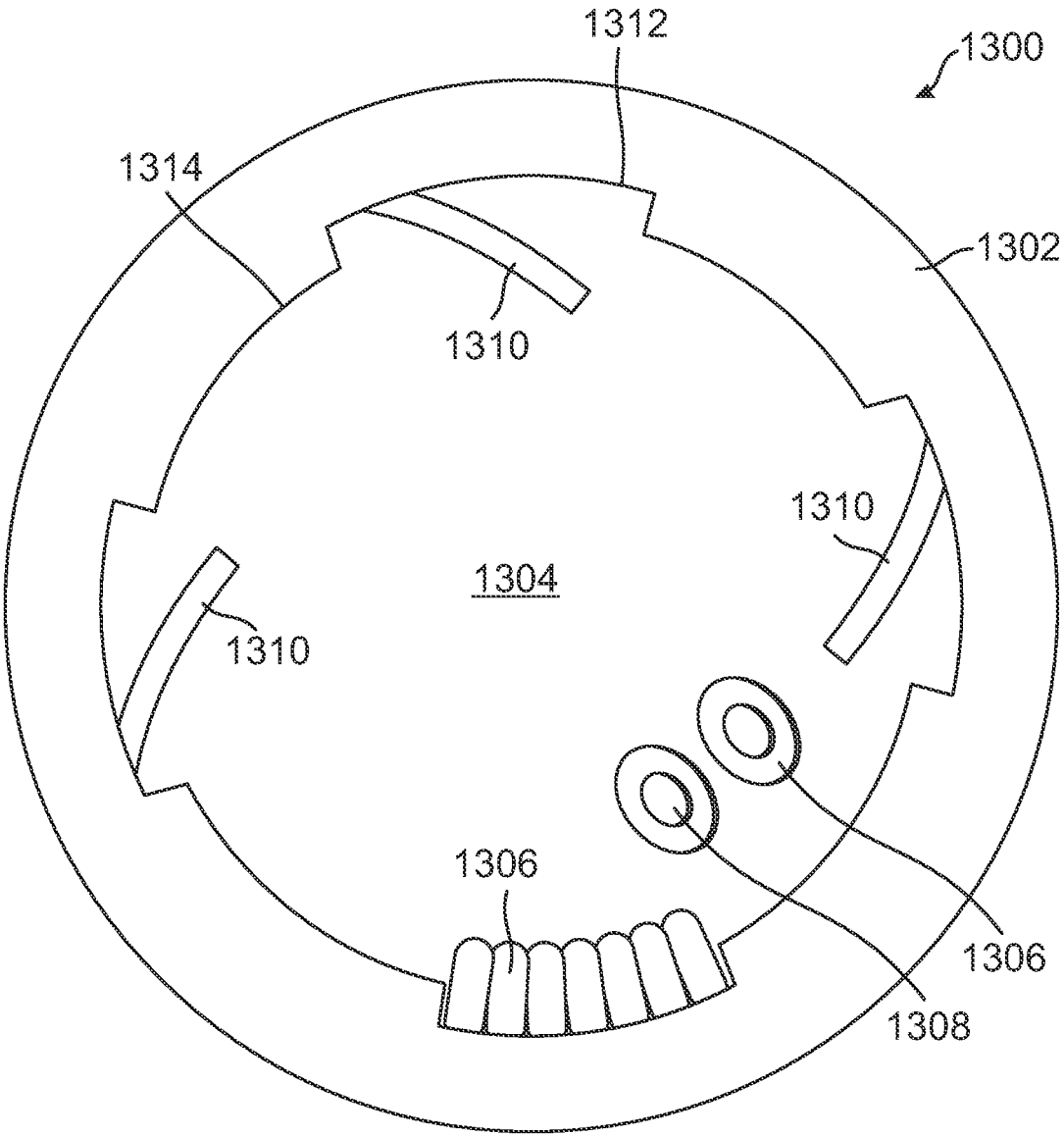
FIG. 14 is a side view of the illustrative jewelry item of FIG. 13 where three axles are shown in the open position and where one axle is shown in the closed position securing a plurality of rotating ornaments thereon.

FIGS. 13 and 14 show another illustrative jewelry item of the present invention wherein the jewelry item is a ring 1300 having multiple ornaments 1306. The ring 1300 has a body 1302 and the body 1302 is shown as having a closed circular shape. The body 1302 defines a circular opening 1304 through which a user may insert their finger. The body 1302 of the ring 1300 may also include multiple axles 1310 for retaining different sets of ornaments 1306. The body 1302 may have one or more grooves 1312 formed along its inner circumference 1314. The grooves 1312 may be spaced apart along the inner circumference 1314 of the body 1302. A first end of an axle 1310 may be coupled to one end of a groove 1312 and the second end of the axle 1310 may be coupled to the opposite end of the groove 1312.

Similar to other embodiments described herein, each axle 1310 may have a diameter that is smaller than a diameter of the hole 1308 of each ornament 1306. This configuration allows the ornaments 1306 to rotate freely about the axle 1310. This configuration also allows the ornaments 1306 to slide freely along the length of the axle 1310. Alternatively, the diameter of the axle 1310 may be equal to the diameter of the hole of the ornament 1306, thereby preventing the ornament 1306 from rotating about the axle 1310 and preventing the ornament 1306 from sliding along the length of the axle 1310.

Although FIG. 13 shows each axle 1310 being full of ornaments 1306, each axle 1310 may have a smaller number of ornaments 1306, thus allowing more room for the ornaments 1306 to move within the groove 1312.

The foregoing description is provided to enable any person skilled in the relevant art to practice the various embodiments described herein. Various modifications to these embodiments will be readily apparent to those skilled in the relevant art and generic principles defined herein may be applied to other embodiments. Thus, the claims are not intended to be limited to the embodiments shown and described herein, but are to be accorded the full scope consistent with the language of the claims, wherein reference to an element in the singular is not intended to mean "one and only one" unless specifically stated, but rather "one or more." All structural and functional equivalents to the elements of the various embodiments described throughout this disclosure that are known or later come to be known to those of ordinary skill in the relevant art are expressly incorporated herein by reference and intended to be encompassed by the claims. Moreover, nothing disclosed herein is intended to be dedicated to the public regardless of whether such disclosure is explicitly recited in the claims.

What is claimed is:

1. A jewelry item comprising:

a body having an open configuration with two open ends;

at least one axle coupled to the body;

at least one ornament coupled to the at least one axle;

at least a first prong coupled to and extending outwardly from one open end of the body; and at least a second prong coupled to and extending outwardly from the other open end of the body;

wherein the at least first prong and the at least second prong together secure a stone thereto; and wherein the at least one ornament is coupled to the at least one axle by passing the at least one axle through a hole defined by the at least one ornament.

2. The jewelry item of claim 1 wherein a first end of the at least one axle is coupled to one open end of the body and a second end of the at least one axle is coupled to the other open end of the body.

3. The jewelry item of claim 1 wherein a first end of the at least one axle is coupled to the body at a position below one open end of the body and a second end of the at least one axle is coupled to the body at a position below the other open end of the body.

4. The jewelry item of claim 1 wherein a diameter of the at least one axle is less than a diameter of the hole defined by the at least one ornament, thereby allowing the at least one ornament to rotate about the at least one axle and slide along a length of the at least one axle.

5. The jewelry item of claim 1 wherein a diameter of the at least one axle is equal to a diameter of the hole defined by that at least one ornament, thereby preventing movement of the at least one ornament about the at least one axle.

6. The jewelry item of claim 1 further comprising a circular retainer coupled about the at least first prong and the at least second prong, wherein the circular retainer further secures the stone thereto.

7. The jewelry item of claim 1 further comprising:

two prongs coupled to and extending outwardly from the one end of the body; and two prongs coupled to and extending outwardly from the other open end of the body;

wherein the two prongs coupled to and extending outwardly from the one end of the body and the two prongs coupled to and extending outwardly from the other open end of the body together secure a stone thereto.

8. A jewelry item with rotating ornaments comprising:

a body having an open configuration with two open ends;

at least one axle, wherein a first end of the at least one axle is coupled to a first open end of the body and a second end of the at least one axle is coupled to a second open end of the body;

at least one ornament coupled to the at least one axle;

at least a first prong coupled to and extending outwardly from the first open end of the body;

at least a second prong coupled to and extending outwardly from the second open end of the body;

wherein the at least first prong and the at least second prong together secure a stone thereto;

wherein the at least one ornament is coupled to the at least one axle by passing the at least one axle through a hole defined by the at least one ornament; and wherein a diameter of the at least one axle is less than a diameter of the hole defined by the at least one ornament, thereby allowing the at least one ornament to rotate about the at least one axle and slide along a length of the at least one axle.

9. The jewelry item of claim 8 further comprising:

two prongs coupled to and extending outwardly from the first open end of the body; and two prongs coupled to and extending outwardly from the second open end of the body;

wherein the two prongs coupled to and extending outwardly from the first open end of the body and the two prongs coupled to and extending outwardly from the second open end of the body together secure a stone thereto.

10. The jewelry item of claim 8 further comprising a circular retainer coupled about the at least first prong and the at least second prong, wherein the circular retainer further secures the stone thereto.

11. A jewelry item with rotating ornaments comprising:

a body having an open configuration with two open ends;

at least one axle, wherein a first end of the at least one axle is coupled to the body at a position below a first open end of the body and a second end of the at least one axle is coupled to the body at a position below a second open end of the body;

at least one ornament coupled to the at least one axle;

at least a first prong coupled to and extending outwardly from the first open end of the body;

at least a second prong coupled to and extending outwardly from the second open end of the body;

wherein the at least first prong and the at least second prong together secure a stone thereto; and wherein the at least one ornament is coupled to the at least one axle by passing the at least one axle through a hole defined by the at least one ornament.

12. The jewelry item of claim 11 wherein a diameter of the at least one axle is less than a diameter of the hole defined by the at least one ornament, thereby allowing the at least one ornament to rotate about the at least one axle and slide along a length of the at least one axle.

13. The jewelry item of claim 11 wherein a diameter of the at least one axle is equal to a diameter of the hole defined by that at least one ornament, thereby preventing movement of the at least one ornament about the at least one axle.

14. The jewelry item of claim 11 further comprising a circular retainer coupled about the at least first prong and the at least second prong, wherein the circular retainer further secures the stone thereto.

15. The jewelry item of claim 11 further comprising:

two prongs coupled to and extending outwardly from the first open end of the body; and two prongs coupled to and extending outwardly from the second open end of the body;

wherein the two prongs coupled to and extending outwardly from the first open end of the body and the two prongs coupled to and extending outwardly from the second open end of the body together secure a stone thereto.

* * * * *